US011441363B2

(12) United States Patent
Bishop et al.

(10) Patent No.: US 11,441,363 B2
(45) Date of Patent: Sep. 13, 2022

(54) ESP TUBING WET CONNECT TOOL

(71) Applicant: Baker Hughes Oilfield Operations LLC, Houston, TX (US)

(72) Inventors: David Spencer Bishop, Cypress, TX (US); Marc N. Samuelson, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/082,173

(22) Filed: Oct. 28, 2020

(65) Prior Publication Data

US 2021/0140247 A1 May 13, 2021

Related U.S. Application Data

(60) Provisional application No. 62/932,142, filed on Nov. 7, 2019.

(51) Int. Cl.
*E21B 17/02* (2006.01)
*E21B 43/12* (2006.01)

(52) U.S. Cl.
CPC ..... *E21B 17/028* (2013.01); *E21B 43/128* (2013.01)

(58) Field of Classification Search
CPC .... E21B 17/028; E21B 43/128; E21B 17/023; E21B 23/02; E21B 23/0418
See application file for complete search history.

(56) References Cited

U.S. PATENT DOCUMENTS

| | | | | |
|---|---|---|---|---|
| 6,681,861 | B2 | 1/2004 | Davidson | |
| 7,086,473 | B1 | 8/2006 | Bangash | |
| 7,814,969 | B2 * | 10/2010 | Shaw | E21B 43/128 166/65.1 |
| 8,286,712 | B2 * | 10/2012 | Wilson | E21B 43/128 166/338 |
| 8,985,972 | B2 * | 3/2015 | Tetzlaff | F04B 17/04 417/423.3 |
| 9,166,352 | B2 * | 10/2015 | Hansen | E21B 17/028 |
| 2007/0227727 | A1 * | 10/2007 | Patel | E21B 17/028 166/250.01 |

(Continued)

OTHER PUBLICATIONS

International Search Report and Written Opinion for International Patent Application No. PCT/US2020/059504, dated Feb. 10, 2021, 13 pgs.

*Primary Examiner* — Michael R Wills, III
(74) *Attorney, Agent, or Firm* — Sprinkle IP Law Group

(57) ABSTRACT

Systems and methods for installing and removing a downhole electric tool in a well, independent of an upper completion in the well. A connector on the interior of a tubular structure (e.g., production tubing or casing) serves as an electrical socket for the tool. This connector is coupled to electrical cables which run from the connector to the surface. The tool, which is raised and lowered on a wireline, slick line or coiled tubing, is plugged into this connector so the tool can be pulled from the socket using the wireline/slick line/coiled tubing and removed from the well without having to remove the tubular structure or other parts of the completion. A replacement tool can then be lowered into the tubular structure and, when the tool lands on the connector, it engages the connector and couples the tool through the cabling to the surface equipment.

16 Claims, 4 Drawing Sheets

(56) References Cited

U.S. PATENT DOCUMENTS

| | | | | |
|---|---|---|---|---|
| 2010/0025045 | A1* | 2/2010 | Lake | E21B 34/066 166/373 |
| 2010/0206577 | A1* | 8/2010 | Martinez | E21B 23/14 166/369 |
| 2010/0243263 | A1* | 9/2010 | Tetzlaff | E21B 43/128 166/369 |
| 2011/0011596 | A1* | 1/2011 | Martinez | E21B 17/028 166/372 |
| 2011/0030972 | A1* | 2/2011 | Brookbank | E21B 17/028 166/381 |
| 2012/0118563 | A1 | 5/2012 | Tetzlaff | |
| 2014/0020907 | A1 | 1/2014 | Head | |
| 2015/0129240 | A1 | 5/2015 | Bishop | |
| 2019/0292889 | A1* | 9/2019 | Hansen | E21B 43/128 |
| 2021/0010333 | A1* | 1/2021 | El Mallawany | E21B 17/06 |

* cited by examiner

ESP TUBING WET CONNECT TOOL

RELATED APPLICATIONS

This application claims a benefit of priority under 35 U.S.C. § 119 to U.S. Provisional Application No. 62/932,142, entitled "ESP TUBING WET CONNECT TOOL", filed Nov. 7, 2019, which is fully incorporated herein by reference for all purposes.

BACKGROUND

Field of the Invention

The invention relates generally to downhole equipment for use in wells, and more particularly to systems and methods for using "wet connect" connectors to couple downhole equipment such as an electric submersible pump ("ESP") to surface equipment such as a power supply, and to allow the downhole equipment to be retrieved from the well while leaving the upper completion installed in the well.

Related Art

ESPs are commonly used to pump oil from wells. Conventionally, a power cable (and potentially other electric lines) are connected to an ESP and is lowered into the well with the ESP when it is installed. Commonly, the ESP is coupled to the end of production tubing which is used to suspend the ESP and lower it into the well. The tubing is positioned so that the ESP is located in the well bore where fluid from the surrounding geological formation is allowed to flow into the well. Power is then provided to the ESP via the power cable to operate it and to pump the fluid from the well. The power cable or other electrical lines may also be used to communicate various parameters (e.g., motor temperature, fluid temperature, fluid pressure, etc.) to the surface from gauges coupled to the ESP.

The lower completion ESPs typically have a lifespan of about 3-5 years, which is a relatively short time in comparison to the lifespans of the remainder of the completion equipment which may last much longer. Ease of replacement is therefore a very important factor in the design of well equipment.

The ESP is a component of the well completion, which includes the various downhole tubulars and equipment which is necessary to enable production from an oil or gas well. The lower completion may include various equipment, such as intelligent slides, hydraulic slides, electric gauges, and the like. The ESP is generally considered to be part of the "upper" completion of the well. In some instances, the upper completion is electrically coupled to the lower completion using a wet connect connector that allows the upper completion to be pulled from the well when the ESP has reached the end of its lifespan.

Even though the upper completion can be removed from the well without having to remove the lower completion, it is nevertheless costly and time-consuming to have to pull the entire upper completion from the well when the ESP needs to be removed and replaced. It would therefore be desirable to provide a means to replace the ESP without having to retrieve the upper completion from the well.

SUMMARY

The present systems and methods are therefore designed to allow the ESP to be moved without having to pull the upper completion out of the well. In other words, the entire completion, with the exception of the ESP, is left in the well when the ESP is removed. This is accomplished by providing a connector inside a tubular structure of the completion (e.g., the production tubing or well casing), where the connector effectively serves as an electrical socket for the ESP. This connector is coupled to electrical cables or components external to the ESP. In one embodiment, contacts of the connector inside the tubular structure are connected to cables which run from the connector to the surface (e.g., to a power source or other control equipment) on the outside of the production tubing. The ESP, which is coupled to a wireline, slick line, or even coiled tubing (which may be necessary in some instances because of the weight of the ESP) so that it can be lowered and raised during installation and removal of the tool, is plugged into this connector. The ESP can therefore be pulled from the socket using the wireline/slick line/coiled tubing and removed from the well without having to remove the tubular structure, or power cabling, or other electrical cabling for the ESP, or the safety valve, or other parts of the completion. A replacement ESP can then be lowered into the tubular structure and, when the ESP lands on the connector, it engages the connector and couples the ESP through the cabling (which extends upward along the outside of the tubular structure and remained in the well when the ESP was removed) to the surface equipment. Thus, the workover of the well may be much less expensive than if a more conventional system is used.

One embodiment comprises a system having an electric downhole tool and an upper completion installed in a well, wherein the upper completion includes production tubing. The production tubing has a downhole connector positioned on its inner surface connected by one or more electrical lines to a power source at a surface of the well. The downhole tool has a tool connector positioned on its outer surface of the tool which is electrically coupled through the housing of the tool to one or more electronic components within the housing of the tool. The tool is configured to be lowered into the production tubing of the upper completion so that the tool connector engages the downhole connector and electrically connects the electronic components within the housing of the tool to the power source through the connectors. The tool is configured so that retrieval of the tool from the production tubing (e.g., by pulling up the line on which the tool is suspended) causes the tool connector to disengage the downhole connector and thereby electrically disconnect the electronic components within the housing of the tool from the power source without removing the upper completion from the well. The electric downhole tool may be, for example, an electric submersible pump (ESP). The ESP may be configured to be suspended from a line, such as a slickline, a wireline, or coiled tubing during installation and retrieval, where the ESP is installed in a well by being lowered by the line into the production tubing, and is removed from the well by being raised on the line within the production tubing.

In one embodiment, the electrical lines coupled between the downhole connector and the power source comprise tubing encapsulated conductors (TECs) mounted on the production tubing in the annulus between the production tubing and the casing of the well. The production tubing may have a landing on the interior of the tubing, where the landing is configured to receive a lower end of the tool and to prevent the tool from being lowered below the landing. The landing may be configured to provide axial alignment of the tool connector with the downhole connector when the tool is seated on the landing. The tool connector may be concentric with the tool and substantially axially symmetric about the axis of the tool, while the downhole connector may be concentric with the production tubing and axially symmetric about the axis of the production tubing.

In one embodiment, each of the tool and the production tubing has a retractable sleeve which is movable alternately open and closed positions, wherein in the closed position the retractable sleeve covers the contacts of the corresponding connector so that they are not exposed, and where in the open position the retractable sleeve exposes the contacts of the corresponding connector so that they can be coupled to the contacts of the other connector. The retractable sleeves may be biased by springs toward the closed position, where the retractable sleeve is movable to the open position by contact with a surface of the tool or the production tubing. The tool and the production tubing may each have a chamber that contains a dielectric fluid, where when the retractable sleeve is in the open position, the contacts of the corresponding connector are in fluid communication with the chamber so that the contacts are surrounded by the dielectric fluid.

An alternative embodiment comprises a wet-connect tool including an electric downhole tool such as an ESP which is configured to be suspended in a well bore, and one or more connectors positioned on an outer surface of the tool. The connectors are electrically coupled through a housing of the tool to one or more electronic components within the housing of the tool. The tool may be suspended from a line such as a slickline, a wireline, or coiled tubing during installation and retrieval. This allows the tool to be lowered into production tubing that has been installed as part of an upper completion in a well, where the production tubing has one or more downhole connectors on an inner surface of the tubing. When the tool is lowered into the production tubing, the connectors of the tool engage the downhole connectors and electrically connect the electronic components within the housing of the tool to a power source through the downhole connectors. The tool is further configured so that retrieval of the tool from the production tubing causes the connectors of the tool to disengage the downhole connectors and thereby electrically disconnect the electronic components within the tool from the power source without removing the upper completion from the well.

In one embodiment, the connectors on the outer surface of the tool are concentric with the tool and are axially symmetric about an axis of the tool. The connectors may include annular contacts that encircle the tool and present a contact surface which is continuous around a circumference of the contact. The annular contacts are conductive and are electrically coupled to corresponding leads of electrical components contained within the housing of the tool. The connectors may also include electrical insulators positioned between the annular contacts.

The wet-connect tool may include a retractable sleeve which is movable between first and second positions, where in the first position the retractable sleeve covers the annular contacts so that they are not exposed to the exterior of the tool, and in the second position the retractable sleeve exposes the annular contacts to the exterior of the tool. The tool may include a chamber that contains a dielectric fluid, so that when the retractable sleeve is in the second, open position, the contacts are in fluid communication with the chamber. The retractable sleeve may be biased by springs toward the first, where the sleeve is movable to the second position by contact with a surface of a landing in the production tubing.

Another alternative embodiment may comprise a method for installing an electric downhole tool such as an ESP in production tubing of an upper completion in a well. This method includes providing downhole connectors on an inner surface of the production tubing, wherein the downhole connectors are connected by electrical lines to a power source at a surface of the well. Connectors are also provided on an outer surface of the tool, where these connectors are electrically coupled through the housing of the tool to electronic components located within the tool. The method further includes positioning the tool in the production tubing such that the connectors on the outer surface of the tool engage the downhole connectors on the inner surface of the production tubing, thereby electrically connecting the electronic components within the tool to the power source. The method further includes removing the tool from the production tubing while the upper completion remains in the well, where removing the tool from the production tubing causes the connectors of the tool to disengage the downhole connectors and thereby electrically disconnect the electronic components within the tool from the power source.

Numerous other embodiments may also be possible.

BRIEF DESCRIPTION OF THE DRAWINGS

Other objects and advantages of the invention may become apparent upon reading the following detailed description and upon reference to the accompanying drawings.

Figure 1:
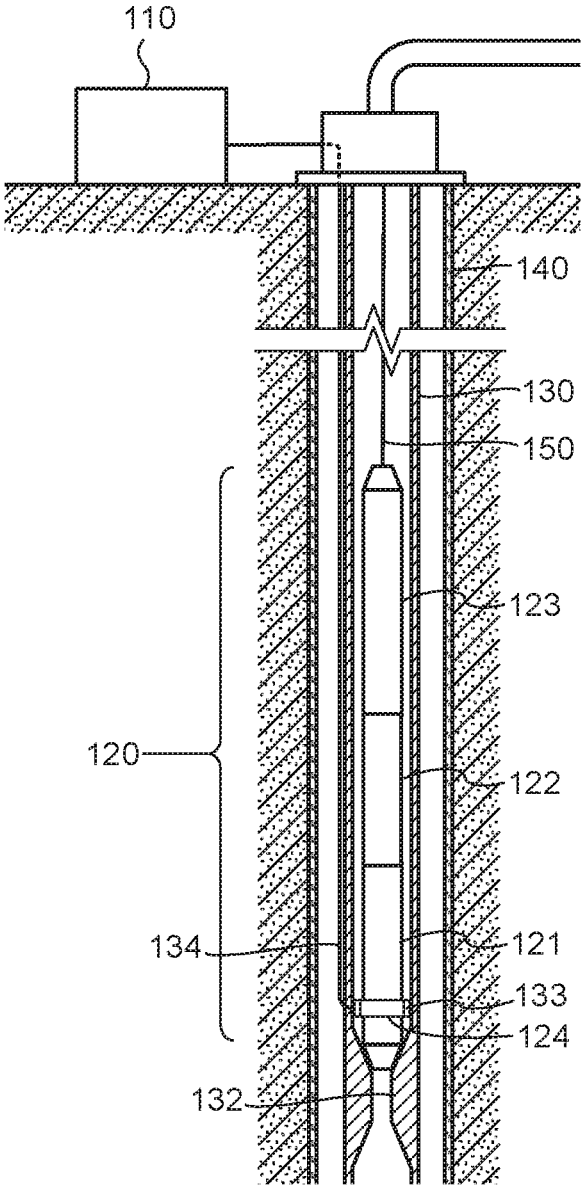
FIG. 1 is a diagram illustrating an exemplary implementation of ESP having a wet connect in accordance with some embodiments.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

As described herein, various embodiments of the invention comprise systems and methods for coupling downhole equipment to surface equipment using "wet connect" connectors to allow the downhole equipment to be retrieved from the well while leaving the upper completion installed in the well.

In an exemplary embodiment, a wet connect system is implemented in the connection of an ESP to in-well cabling that provides power from an electric drive system at the surface of the well. The wet connect system includes a circumferential (ring-like) connector that is mounted on the inner surface of the production tubing that is installed in the well. (In alternative embodiments, this connector may be installed on the interior of the well casing instead of the production tubing.) A power cable that extends along the outer surface of the production tubing from the circumferential connector to the surface equipment. A complementary circumferential connector is mounted on the outer surface of the ESP housing. This connector is electrically connected to conductors that extend through the housing of the ESP to the electrical components of the ESP.

The ESP, is coupled to a line (e.g., wireline, slick line, or even coiled tubing) which is used to lower the ESP into the production tubing. When the ESP reaches the connector mounted on the production tubing, the lower end of the ESP is inserted through the center of the tubing connector until the tubing connector engages the connector mounted on the ESP. In this embodiment, the ESP connector will be positioned coaxially within the tubing connector, with ring-like contacts of the two connectors engaging each other. Because the contacts of the connectors extend all the way around the circumference of the connectors, the connectors provide a very large contact surface for transmission of power through the connection. A shoulder or stop is provided to stop the ESP when it reaches the position at which the connectors are fully engaged. After the ESP has been run into the well, the line from which it was suspended may be disconnected.

When the ESP needs to be removed for repair or replacement, the ESP is simply retrieved by running the line (e.g., wireline/slick line/coiled tubing) into the well, connecting the line to the ESP (e.g., by catching a fishing neck at the top of the ESP), and pulling the ESP out of the production tubing using the attached line. When the ESP is raised, the production tubing, power cabling, and the rest of the completion remain in place in the well. A replacement ESP (the repaired ESP or a new ESP) can then be lowered into the production tubing. When the ESP lands at the connector, it engages the connector and couples the ESP to the cabling and the surface equipment.

Embodiments of the wet connect system of the present invention are described in more detail below with reference to FIGS. 1-3.

Referring to FIG. 1, a diagram illustrating an exemplary implementation of ESP having a wet connect in accordance with one embodiment is shown. In this embodiment, an artificial lift system is installed as part of the well completion. The artificial lift system includes an ESP 120 and an electric drive 110 that is configured to drive the ESP to pump fluids out of the well. ESP 120 may, for example, include a motor section 121, a seal section 122, and a pump section 123. ESP 120 may also include various other components, such as a gauge package with sensors, transceivers or the like.

When it is installed in the well, motor section 121 is coupled to drive system 110 to receive power (typically three-phase AC power) to drive the motor section. Motor section 121 is coupled to pump section 123 through seal section 122 to drive the pump section, thereby pumping the oil or other fluid through the tubing string and out of the well. Seal section 122 is provided between motor section 121 and pump section 123 for purposes including equalizing the pressure between the motor interior and the well bore and allowing the oil within the motor to expand and contract.

ESP 120 is coupled to a line 150 which suspends the ESP as it is lowered into the well when it is installed, and which is used to retrieve the ESP from the well when it is necessary to repair or replace the ESP. Line 150 may be, for example, a slickline or a wireline. If the weight of the ESP requires it, coiled tubing may be used for line 150. Line 150 may be detached from the ESP when the ESP is installed in the well.

ESP 120 is installed within production tubing 130. Production tubing 130 has an upper portion which has an inner diameter that is large enough to accommodate ESP 120. In other words, the inner diameter of this portion of production tubing 130 is greater than the overall outer diameter of ESP 120 so that the ESP can be lowered into the well within the production tubing. Production tubing 130 also has a lower portion which has a narrowed inner diameter which effectively forms a landing 132 or socket for ESP 120. A connector 133 is positioned on the inner diameter of production tubing 130 at or near the landing. Connector 133 is electrically coupled to the conductors of a power cable 134 that is positioned at the exterior of production tubing 130, in the annulus between the production tubing and casing 140 which is installed in the well.

When ESP 120 reaches the landing in the lower portion of the production tubing, the lower end of the ESP effectively mates with the landing in the lower portion of the production tubing. ESP 120 has a connector 124 on its outer surface that is configured to mate with connector 133 which is installed on the inner surface of production tubing 130. The lower end of ESP 120 is tapered to facilitate alignment of the ESP's connector with production tubing connector 133 as the ESP reaches the landing. When connector 124 of the ESP engages connector 133 of the production tubing, ESP 120 is electrically coupled via a power cable 134 to electric drive 110 so that the drive can provide power to motor 121 of the ESP and thereby drive the ESP to pump fluids through production tubing 130 and produce them from the well.

Figure 2A:
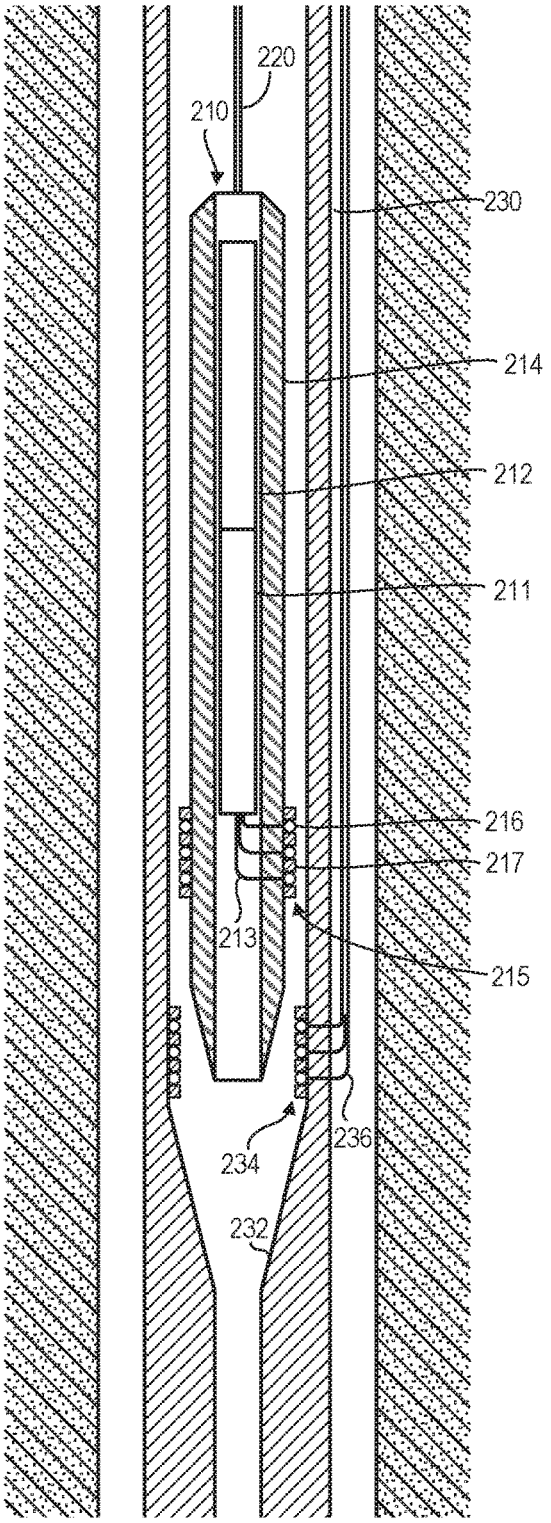
FIGS. 2A and 2B are a pair of diagrams illustrating the general structure of a wet-connect system used in connection with a downhole electric tool in accordance with some embodiments.
Figure 2B:
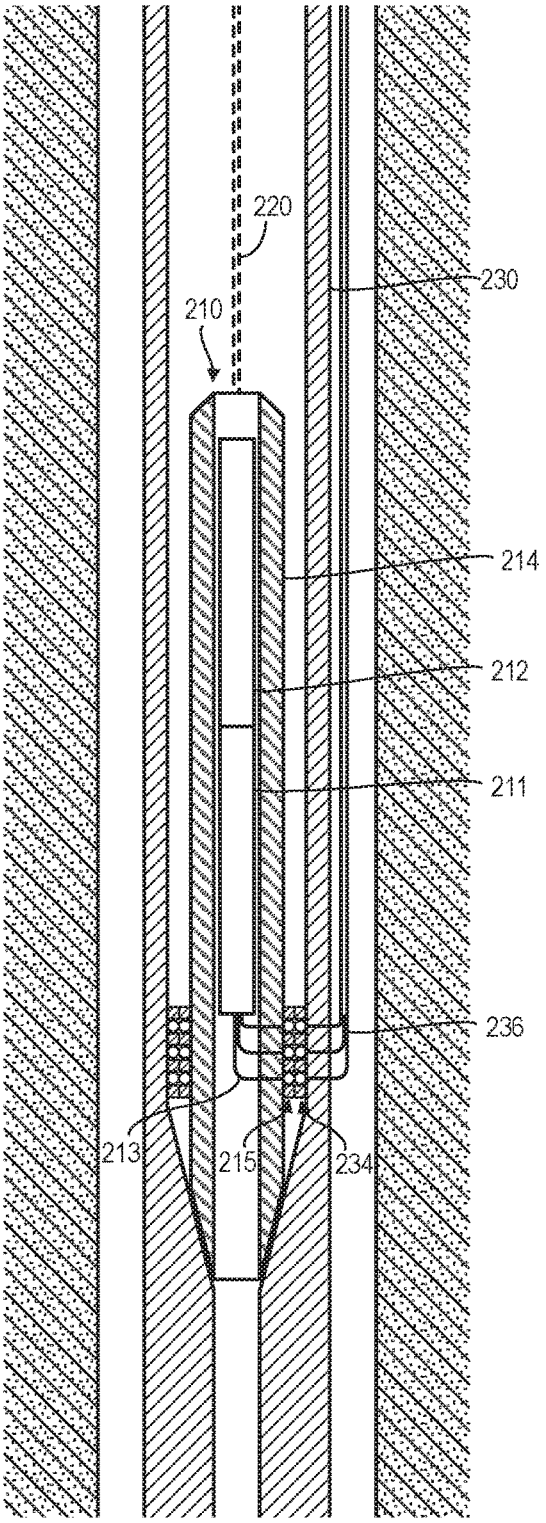

Referring to FIGS. 2A and 2B, a pair of diagrams illustrating the general structure of a wet-connect system used in connection with a downhole electric tool according to some embodiments is shown. FIG. 2A shows the downhole electric tool in a raised position in which the tool is suspended within production tubing in a well. FIG. 2B shows the downhole electric tool in a lowered position in which the tool is engaged with a landing structure within the production tubing.

As depicted in these figures, an electric downhole tool 210 is coupled to a line 220 so that the tool can be suspended on the line and raised or lowered within a well. Tool 210 contains one or more internal components (211, 212) within a housing 214, where these internal components require power from an external source. Internal components 211, 212 may also be configured to make use of a wired connection to external components for the purpose of sensing, communication, etc.

Internal components 211, 212 of downhole tool 210 are electrically connected via wires or cables 213 which extend through housing 214 to a connector 215 which is installed at the exterior of the housing. As depicted in the figure, connector 215 has a set of electrical contacts 216, as well as a set of electrical insulators 217 which electrically isolate the individual contacts from each other and from the housing of the tool. Electrical insulation may also be provided to isolate the conductors of the wires or cables.

As shown in FIG. 2A, downhole electric tool 210 may be suspended from line 220 in order to lower the tool into the well, or to raise the tool and retrieve it from the well. Line 220 may be detached from tool 210 when the tool in installed in the well. Tool 210 is installed within the production tubing 230, and is raised or lowered independently of the production tubing. Tool 210 may therefore be installed or retrieved independently of the production tubing and the remainder of the well completion equipment.

The upper section of production tubing 230 has an inner diameter that is greater than an overall outer diameter of the tool so that the tool can be raised or lowered freely within the production tubing. When downhole electric tool 210 is installed, the tool is lowered through an upper section of the production tubing 230. As downhole electric tool 210 is being lowered, connector 215 is not engaged, and the contacts 216 of the connector are not electrically coupled to any contacts or other conductors external to the tool.

Production tubing 230 has a lower section which has a landing 232. The landing is depicted in this figure as a narrowed section of the tubing which has an inner diameter that is less than the overall outer diameter of downhole electric tool 210. When tool 210 reaches landing 232, the lower end of the tool engages the landing, which prevents the tool from being lowered further into the tubing. While this embodiment uses a narrowed inner diameter to form the landing, other embodiments may use shoulders, stops, or various alternative structures to serve this purpose.

A connector 234 is positioned just above landing 232 on the inner diameter of production tubing 230. Connector 234 is oriented coaxially with the production tubing and tool so that when downhole electric tool 210 is seated on landing 232, connector 234 will mate with connector 215. When these connectors are mated, the contacts of connector 234 engaged the contacts of connector 215, thereby electrically connecting wires 213 within the tool to a corresponding set of conductors 236 (wires, cables, tubing encapsulated conductors, etc.) which are coupled to the contacts of production tubing connector 234. Wires/cables 236 extend upward, along the exterior of production tubing 230 (in the annulus between the production tubing and the wall of the well bore) until reaching equipment at the surface of the well, such as an electric drive. The wires/cables are fastened in one embodiment to the exterior of the production tubing.

When downhole electric tool 210 is seated on landing 232, power can be provided from the surface, through conductors 236, connectors 234 and 215, and wires 213 to the internal electric components of the downhole tool. Similarly, data (e.g., sensor data, control data, etc.) can be communicated between the internal components of downhole tool 210 and equipment at the surface of the well. If downhole electric tool 210 needs to be removed from the well in order to repair or replace it, the tool can simply be raised on line 220. When the tool is raised from landing 232, connectors 215 and 234 will disengage, with conductors 236 remaining in the well in the annulus between production tubing 230 the wall of the well (which may be cased, although this is not explicitly shown in FIGS. 2A and 2B).

Figure 3A:
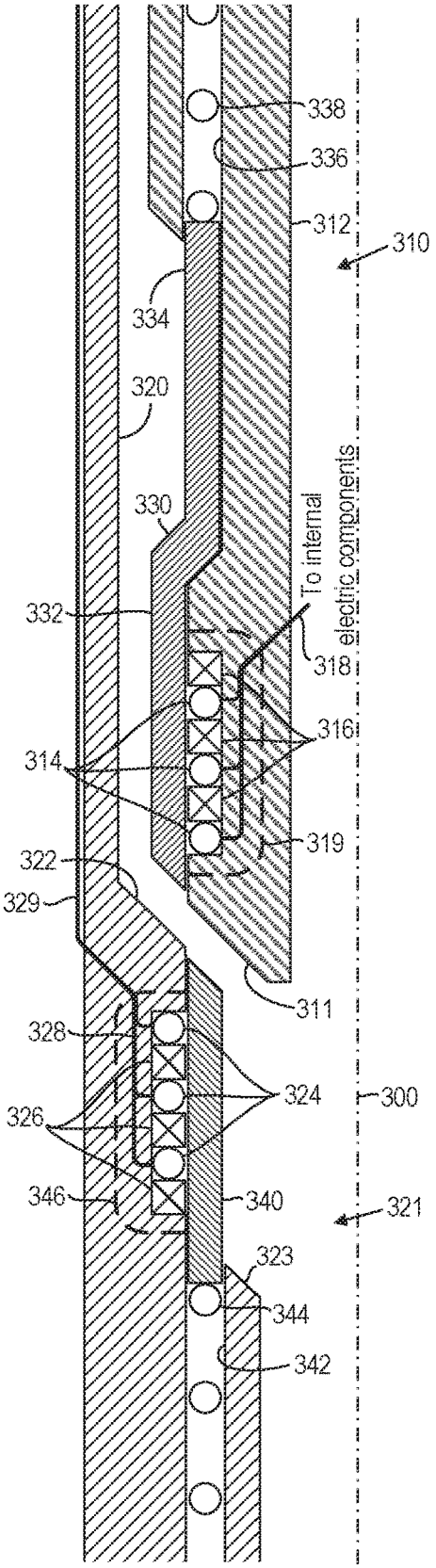
FIGS. 3A and 3B are a pair of diagrams illustrating the structure of an exemplary embodiment of a wet-connect system having sliding protective sleeves in accordance with some embodiments.
Figure 3B:
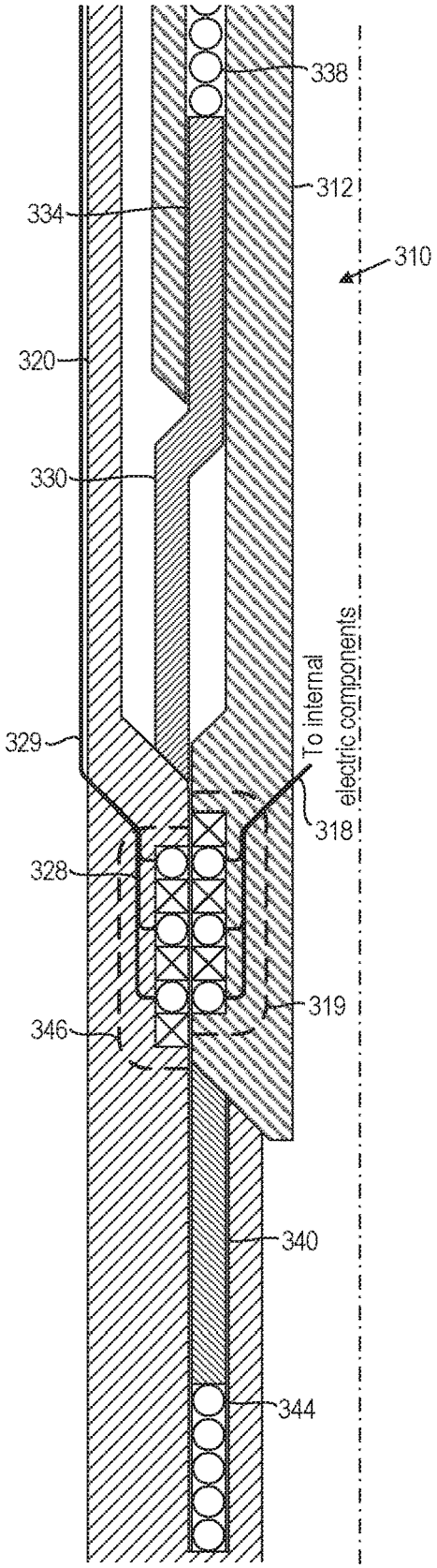

Referring to FIGS. 3A and 3B, a pair of diagrams illustrating the structure of an exemplary embodiment of a wet-connect system having sliding protective sleeves is shown. FIG. 3A shows a downhole tool in a position which is raised above a landing in a section of production tubing so that a pair of retractable sleeves are covering each of the wet-connect connectors. FIG. 3B shows the downhole tool seated on the landing of the production tubing with each of the retractable sleeves withdrawn to allow the wet-connect connectors to engage each other.

Each of FIGS. 3A and 3B is a partial cross-sectional illustration of the downhole tool within the production tubing. The components shown in the drawing are generally concentric and/or substantially symmetric about an axis 300 of the tool 310 and the production tubing 320, except for the electrical lines which connect the contacts of the connectors to the respective electrical components. The axially symmetric configuration allows the ESP to be plugged into the production tubing connector without having to first ensure that the ESP has a particular orientation (rotationally or circumferentially) in order to align the ESP connector with respect to the production tubing connector.

"Substantially symmetric" is used here to indicate that the components have a generally symmetric configuration, but need not be strictly symmetric. For example, am annular electrical contact may be divided into sections to facilitate manufacture, to enable the contact to be movably biased to maintain good electrical contact with the other connector, or for other purposes.

As depicted in these figures, a lower end of the housing 312 of downhole tools 310 has a connector that includes a set of electrical contacts 314 and a set of electrical insulators 316 which are inset into the exterior of housing 312. Insulators 316 electrically isolate each of contacts 314 from the other contacts. Electrical insulation may also be provided to electrically isolate the contacts from housing 312 of the downhole tool.

In this embodiment, each of contacts 314 and insulators 316 is generally annular, or ring-shaped. Insulators 316 similarly extend around the entire circumference of the tool, serving as spacers between contacts 314, as well as insulators. Thus, each contact extends circumferentially around the exterior of downhole tool 310, providing a radially outward facing (away from the tool's axis) contact surface which is omnidirectional. In this embodiment, the contact surface is the same, regardless of the orientation of the downhole tool. In other embodiments, the contact surface may be configured so that the contact surface itself is not necessarily the same in any direction, but the tool may be installed in any rotational orientation, and will still provide good electrical contact with the production tubing connector. As noted above, the full circumferential engagement of the contacts between the tool connector and production tubing connector provides a larger contact area for power transmission than conventional pin-type connectors. This greater area is advantageous when providing power to a tool such as an ESP, which requires orders of magnitude more power than sensors or similar devices that are more typically powered with wet-connect systems.

The outward-facing contact surfaces of contacts 314 and insulators 316 are substantially flush with the outer surface of housing 312. They may alternatively be raised slightly with respect to the outer surface of the housing in order to ensure good contact with the components of the complementary connector on the production tubing. While contacts 314 are depicted in the figure as having round cross-sections for purposes of clarity, they may have any suitable cross-section. Each of contacts 314 is connected to a corresponding wire 318 which electrically couples the contact to a corresponding lead, connector, contact, or the like of an internal electrical component of downhole tool 310 (e.g., an ESP motor, sensor, gauge, transceiver, etc.)

A retractable sleeve 330 is provided in this embodiment to serve as a protective cover for the components of the tool connector (conductors 314 and insulators 316). Retractable sleeve 330 is configured to slide axially (up and down in the figure) on housing 312. Retractable sleeve 330 is configured to move between a first, closed position in which a lower portion 332 of the sleeve covers the tool connector and a second, open position in which the sleeve is retracted to expose the connector. Retractable sleeve 330 is shown in the first position in FIG. 3A, and is shown in the second position in FIG. 3B. An upper portion 334 of retractable sleeve 330 fits within a recess 336 within tool housing 312. A spring 338 is positioned in recess 336 in order to urge retractable sleeve 330 toward the first, closed position. Thus, retractable sleeve 330 normally remains in the first, closed position unless it is forced upward to the second, open position (e.g., by contact with the landing of the production tubing).

As noted above, production tubing 320 has a landing 321, which is a structure in the tubing that has a narrowed diameter so that downhole tool 310 cannot be lowered beyond the landing. The landing has a connector which is complementary to the connector of the production tubing. This connector includes a set of annular contacts 324 which are separated by electrical insulators 326. Contacts 324 have radially inward facing contact surfaces (toward the axis of the tool and production tubing). The contacts are depicted in the figure as having round cross-sections, but they may have any suitable shape.

Each of contacts 324 is electrically connected to a corresponding wire or other conductor 328. These wires extend through production tubing 320 to the exterior of the tubing and are coupled to cabling, tubing encapsulated conductors, or the like 329 which extend upward in the annulus between the production tubing and the casing (or wall of the well) to equipment at the surface of the well.

Similar to downhole tool 310, the landing in the production tubing has a retractable sleeve 340 at the interior of the tubing. Retractable sleeve 340 is configured to move axially within the tubing. A lower portion of sleeve 340 fits within a recess 342 on the interior of the production tubing, and the sleeve can be pushed into the recess. A spring 344 is positioned in the recess to urge retractable sleeve 340 outward from the recess (upward in the figure). Because it is urged upward by spring 344, retractable sleeve 340 is normally in an upper, closed position in which the sleeve covers the conductors of the production tubing connector. In this position, the retractable sleeve protects the contacts of the connector from damage and exposure to well fluids. Retractable sleeve 340 can, however, be pushed into a lower, open position in which the contacts of the connector are exposed and can be electrically coupled to the contacts of downhole tool 310.

As noted above, FIG. 3A shows the downhole electric tool 310 in a position above the landing, where the tool is not yet in contact with the structure of the landing, while FIG. 3B shows the tool in a position which is seated on the landing.

As the tool is being lowered into the production tubing, the tool has some "play" within the tubing so that it may not be centered within the tubing. When tool 310 reaches the landing, the tapered nose 311 of the tool may contact a complementary tapered surface 322 of the landing in the production tubing, forcing tool 310 into coaxial alignment with the production tubing and the landing. When downhole tool 310 is aligned with the landing, the tool can move downward into the narrowed opening of the landing.

As the tool moves downward from this point, surface 322 of the landing is engaged with retractable sleeve 330, so that as the tool moves downward, the retractable sleeve is pushed into recess 336. Similarly, the tapered nose 311 of downhole tool 310 contacts the upper end of retractable sleeve 340, pushing this retractable sleeve downward into recess 342. As tool 310 moves downward in the retractable sleeves are pushed into their respective recesses, the outward-facing connector of the tool moves into engagement with the inward-facing connector of the landing.

Tool 310 continues to move downward until the tapered nose 311 of the tool reaches a complementary shoulder 323 of the landing. At this point, the tool is seated on the landing, and the landing will prevent further downward movement of the tool. With the tool seated on the landing, each of the contacts 314 of the downhole tool connector is at the same axial position as a corresponding one of the contacts 324 of the production tubing connector, electrically coupling the corresponding wires (318, 328) of the tool and the production tubing. This connects the internal electric components of the downhole tool to the surface equipment so that power can be provided from the surface equipment to the downhole tool, and data may be communicated between the surface equipment and the tool.

Both tool 310 and production tubing 320 may have chambers that are in fluid communication with the contacts of their respective connectors. Chamber 319 in the tool and chamber 346 in the production tubing (represented generally by dashed lines in the figures) contain dielectric fluid which surrounds the conductors. The chamber may include a pressure balancing device such as a bellows, which allows the dielectric fluid in the chamber to provide pressure balance with the hydrostatic pressure of the well fluids surrounding the downhole tool. The dielectric fluid further prevents exposure of the contacts to conductive well fluids which could cause electrical shorts between the contacts. The dielectric fluid may be contained in the chambers by retractable sleeves 330, 340 when they are in their respective closed positions, and may flow between the chambers when the downhole tool is seated on the landing and the respective connectors are engaged with each other. A mechanism may be provided to discharge dielectric fluid onto or between the connectors when the connection is made to wash out any conductive fluid that may be present between or around the connectors. In other embodiments, dielectric fluid may be introduced into the well around the tool when it engages the landing and the connection is made, rather than providing dielectric fluid chambers in the tool and production tubing.

Figure 4A:
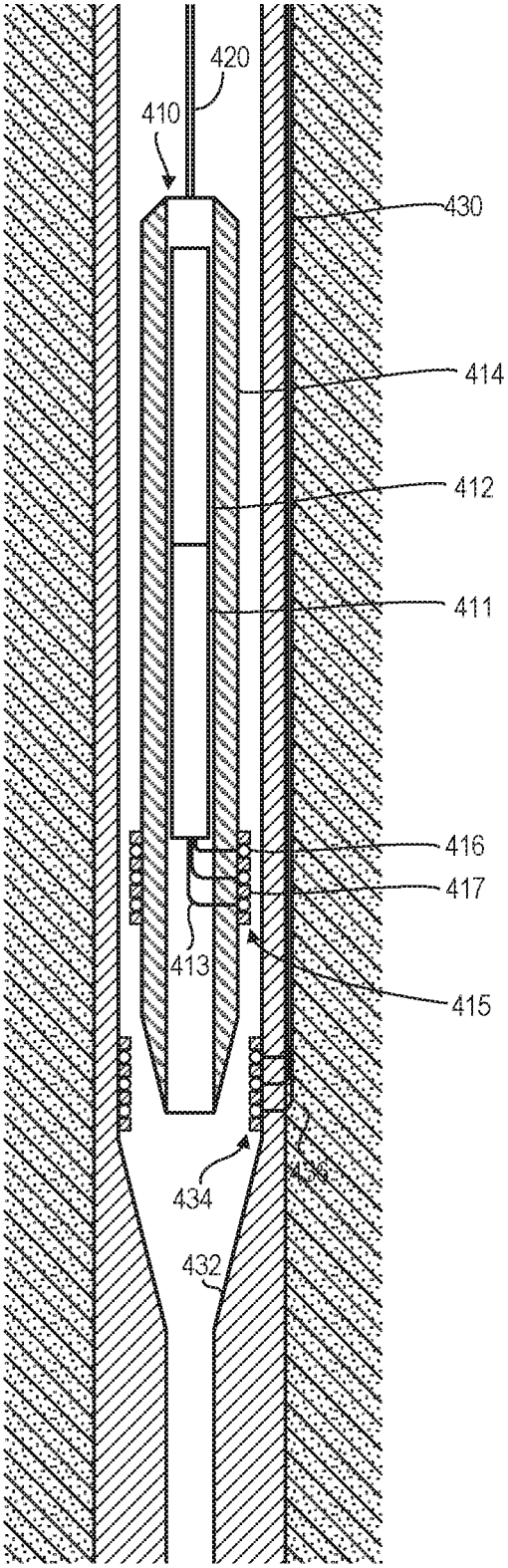
FIGS. 4A and 4B are a pair of diagrams illustrating the general structure of an alternative wet-connect system used in connection with a downhole electric tool in accordance with some embodiments.
Figure 4B:
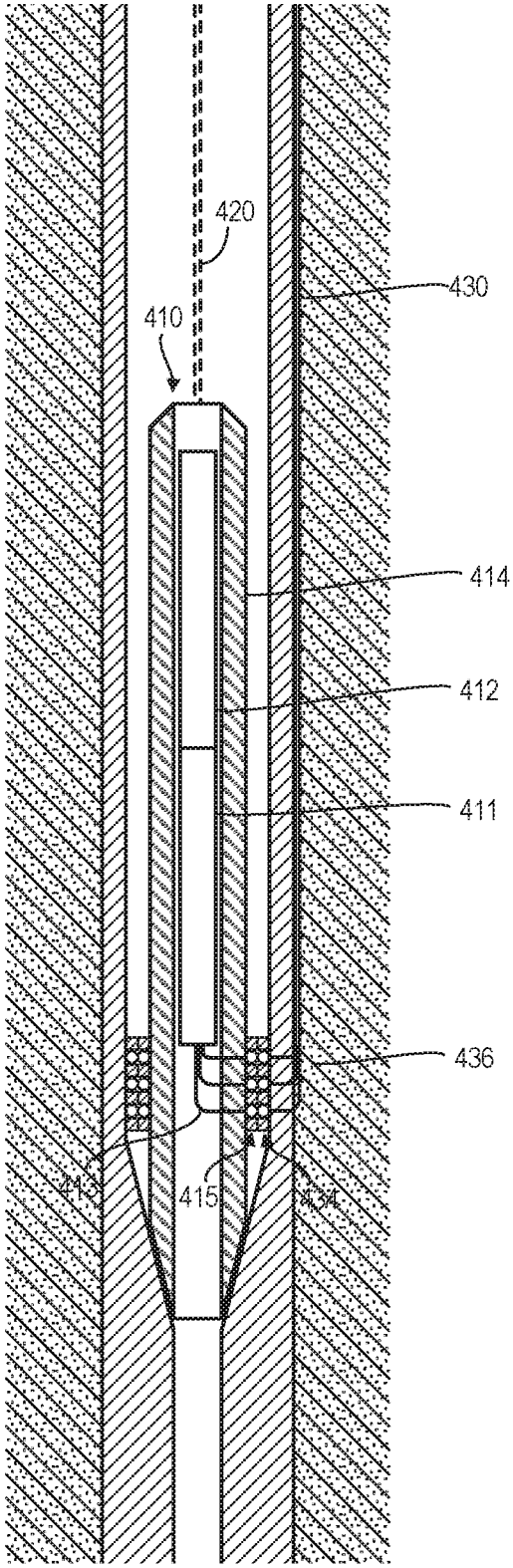

Referring to FIGS. 4A and 4B, a pair of diagrams illustrating the general structure of a wet-connect system used in connection with a downhole electric tool according to an alternative embodiment is shown. In this embodiment, the downhole electric tool is positioned within the casing of the well, where the connector on the exterior of the of the downhole tool engages a connector that is installed on the interior of the casing, instead of the interior of production tubing as depicted in FIGS. 2A and 2B. FIG. 4A shows the downhole electric tool in a raised position in which the tool is suspended within casing in a well. FIG. 4B shows the downhole electric tool in a lowered position in which the tool is engaged with a landing structure within the casing.

As shown in these figures, electric downhole tool 410 is coupled to a line 420 which suspends the tool, allowing it to be raised or lowered within the well. After downhole electric tool 410 is lowered into the well, line 420 may be detached from the tool. Tool 410 is raised or lowered independently of the casing, so it may be installed or retrieved independently of the casing and other well completion equipment.

Tool 410 contains internal components (e.g., 411, 412) within a housing 414, where the internal components require power from an external source. The internal components are electrically connected via wires 413 which extend through housing 414 to a connector 415 installed at the exterior of the housing. Connector 415 has a set of electrical contacts 416 and a set of electrical insulators 417 between the contacts which electrically isolate the contacts from each other and from the housing.

The upper section of casing 430 has an inner diameter which is greater than an overall outer diameter of the tool, so that the tool can be raised or lowered within the casing. To install downhole electric tool 410, the tool is lowered through an upper section of the casing 430. At this point, connector 415 is not engaged, and the contacts 416 of the connector are not electrically coupled to any contacts or other conductors external to the tool.

Casing 430 has a lower section having a landing 432. Landing 432 is shown as a narrowed section of the casing having an inner diameter that is less than the overall outer diameter of downhole electric tool 410, but alternative embodiments may use other structures such as shoulders, stops, or the like to serve this purpose. When tool 410 reaches landing 432, the lower end of the tool engages the landing, preventing the tool from being lowered further into the casing.

Connector 434 is positioned just above landing 432 on the inner diameter of casing 430. Connector 434 is oriented coaxially with the casing and tool so that when downhole electric tool 410 is seated on landing 432, connector 434 will mate with connector 415. When these connectors are mated, the contacts of connector 434 engage the contacts of connector 415, electrically connecting wires 413 within the tool to a corresponding set of conductors 436 (which may be wires, cables, tubing encapsulated conductors, or the like). Conductors 436 are coupled to the contacts of casing connector 434. Wires/cables 436 extend upward, along the exterior of casing 430 until reaching equipment at the surface of the well, such as an electric drive.

When downhole electric tool 410 is seated on landing 432, power can be provided from the surface, through conductors 436, connectors 434 and 415 and wires 413 to the internal electric components of the downhole tool. Similarly, data (e.g., sensor data, control data, etc.) can be communicated between the internal components of downhole tool 410 and equipment at the surface of the well. If downhole electric tool 410 needs to be removed from the well for repair or replacement, the tool can simply be raised on line 420, disengaging connectors 415 and 434, with conductors 436 remaining in the well.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the described embodiments. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the described embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed by the claims of the application.

What is claimed is:

1. A wet-connect tool comprising: an electric downhole tool, wherein the tool is configured to be suspended in a well bore; one or more connectors positioned on an outer surface of the tool, wherein the one or more connectors are electrically coupled through a housing of the tool to one or more electronic components located within the housing of the tool;

wherein the tool is configured so that when the tool is lowered into a tubular structure installed as part of an upper completion in a well, wherein the tubular structure has one or more downhole connectors positioned on an inner surface of the tubular structure, the one or more connectors of the tool engage the one or more downhole connectors and electrically connect the one or more electronic components within the housing of the tool to an external electrical component through the one or more downhole connectors; wherein the tool is configured so that retrieval of the tool from the tubular structure causes the one or more connectors of the tool to disengage the one or more downhole connectors and thereby electrically disconnect the one or more electronic components within the housing of the tool from the external electrical component without removing the upper completion from the well; a retractable sleeve which is movable alternately between a first position and a second position, wherein in the first position the retractable sleeve covers annular contacts so that the annular contacts are not exposed to the exterior of the tool, wherein in the second position the retractable sleeve exposes the annular contacts to the exterior of the tool, wherein the retractable sleeve is biased by one or more springs toward the first position, and wherein the retractable sleeve is movable to the second position by contact with a surface of a landing in a section of the tubular structure; and a chamber that contains a dielectric fluid, wherein when the retractable sleeve is in the second position, the annular contacts are in fluid communication with the chamber.

2. The wet-connect tool of claim 1, wherein the tubular structure comprises production tubing installed in the well, wherein the one or more downhole connectors are positioned on an inner surface of the production tubing, and wherein the tool is configured to removably engage the one or more downhole connectors of the production tubing.

3. The wet-connect tool of claim 1, wherein the tubular structure comprises casing installed in the well, wherein the one or more downhole connectors are positioned on an inner surface of the casing, and wherein the tool is configured to removably engage the one or more downhole connectors of the casing.

4. The wet-connect tool of claim 1, wherein the one or more connectors on the outer surface of the tool are concentric with the tool and are substantially axially symmetric about an axis of the tool, wherein each of the annular contacts encircles the tool and presents a contact surface which is continuous around a circumference of the annular contact, wherein each of the annular contacts is electrically conductive and is electrically coupled to a corresponding lead of an electrical component contained within a housing of the tool.

5. The wet-connect tool of claim 4, wherein the one or more connectors on the outer surface of the tool comprise one or more electrical insulators positioned between the annular contacts, wherein each of the electrical insulators is annular and extends around a circumference of the tool.

6. The wet-connect tool of claim 1, wherein the electric downhole tool comprises an electric submersible pump (ESP).

7. The wet-connect tool of claim 6, wherein the ESP is configured to be suspended from a line, the line selected from the group including a slickline, a wireline and coiled tubing, wherein the ESP is configured to be installed in the well by being lowered by the line into the tubular structure, and wherein the ESP is configured to be removed from the well by being raised on the line within the tubular structure.

8. A system comprising: an upper completion installed in a well, wherein the upper completion includes a tubular structure, the tubular structure having one or more downhole connectors positioned on an inner surface of the tubular structure, wherein the one or more downhole connectors are connected by one or more electrical lines to control equipment at a surface of the well; an electric downhole tool having one or more tool connectors positioned on an outer surface of the tool, wherein the one or more tool connectors are electrically coupled through a housing of the tool to one or more electronic components located within the housing of the tool; wherein the tool is configured to be lowered into the tubular structure of the upper completion wherein the tool is configured so that when the tool is lowered into the tubular structure, the one or more tool connectors engage the one or more downhole connectors and electrically connect the one or more electronic components within the housing of the tool to the control equipment through the one or more downhole connectors; wherein the tool is configured so that retrieval of the tool from the tubular structure causes the one or more tool connectors to disengage the one or more downhole connectors and thereby electrically disconnect the one or more electronic components within the housing of the tool from the control equipment without removing the upper completion from the well; a first retractable sleeve which is movable alternately between a first position and a second position, wherein in the first position the first retractable sleeve covers first annular contacts so that the first annular contacts are not exposed to the exterior of the tool, wherein in the second position the first retractable sleeve exposes the first annular contacts to the exterior of the tool, wherein the first retractable sleeve is biased by one or more springs toward the first position, and wherein the first retractable sleeve is movable to the second position by contact with a surface of a landing in a section of the tubular structure; and a chamber that contains a dielectric fluid, wherein when the first retractable sleeve is in the second position, the annular contacts are in fluid communication with the chamber.

9. The system of claim 8, wherein the control equipment comprises an electric drive which is positioned at the surface of the well and is configured to provide power to the electric downhole tool.

10. The system of claim 8, wherein the tubular structure comprises production tubing installed in the well, wherein the one or more downhole connectors are positioned on an inner surface of production tubing, and wherein the tool is configured to removably engage the one or more downhole connectors of the production tubing.

11. The system of claim 10, wherein the production tubing has a landing within an interior of the production tubing, the landing being configured to receive a lower end of the tool and to prevent the tool from being lowered below the landing, wherein the landing is configured to provide axial alignment of the one or more tool connectors with the one or more downhole connectors when the tool is seated on the landing.

12. The system of claim 10, further comprising a second retractable sleeve which is movable alternately between an open position and a closed position, wherein in the closed position the second retractable sleeve covers a second set of annular contacts of the one or more downhole connectors so that the second set of annular contacts are not exposed to the interior of the production tubing, and wherein in the open position the second retractable sleeve exposes the second set of annular contacts to the interior of the tubular structure.

13. The system of claim 8, wherein the tubular structure comprises casing installed in the well, wherein the one or more downhole connectors are positioned on an inner surface of the casing, and wherein the tool is configured to removably engage the one or more downhole connectors of the casing.

14. The system of claim 8, wherein the one or more electrical lines connected to the downhole connectors comprise one or more tubing encapsulated conductors (TECs) mounted on production tubing in an annulus between the production tubing and a casing of the well.

15. The system of claim 8, wherein the one or more tool connectors are concentric with the tool and are axially symmetric about an axis of the tool, wherein the one or more downhole connectors are concentric with the tubular structure and are axially symmetric about an axis of the tubular structure, and wherein the one or more tool connectors are adapted to engage the one or more downhole connectors in any rotational orientation.

16. A method comprising: installing an electric downhole tool in tubular structure of an upper completion in a well, including providing one or more downhole connectors on an inner surface of the tubular structure, wherein the one or more downhole connectors are connected by one or more electrical lines to a power source at a surface of the well, providing one or more connectors on an outer surface of the tool, wherein the one or more connectors are electrically coupled through a housing of the tool to one or more electronic components located within the housing of the tool, and positioning the tool in the tubular structure such that the one or more connectors on the outer surface of the tool engage the one or more downhole connectors on the inner surface of the tubular structure and thereby electrically connect the one or more electronic components within the housing of the tool to the power source, wherein the tool has a retractable sleeve which is movable alternately between a first position and a second position, wherein in the first position the retractable sleeve covers annular contacts so that the annular contacts are not exposed to the exterior of the tool, wherein in the second position the retractable sleeve exposes the annular contacts to the exterior of the tool, wherein the retractable sleeve is biased by one or more springs toward the first position, and wherein the retractable sleeve is movable to the second position by contact with a surface of a landing in a section of the tubular structure; and wherein the tool has a chamber that contains a dielectric fluid, wherein positioning the tool to engage the one or more connectors on the outer surface of the tool with the one or more downhole connectors on the inner surface of the tubular structure includes moving the retractable sleeve to the second position, thereby placing the annular contacts in fluid communication with the chamber; and removing the tool from the tubular structure while the upper completion remains in the well, wherein removing the tool from the tubular structure causes the one or more connectors of the tool to disengage the one or more downhole connectors of the tubular structure and thereby electrically disconnect the one or more electronic components within the housing of the tool from the power source.

* * * * *